US008963429B2

(12) United States Patent
Liu

(10) Patent No.: US 8,963,429 B2
(45) Date of Patent: Feb. 24, 2015

(54) LIGHTING APPARATUS FOR FLUORESCENT TUBE AND DRIVING METHOD THEREFOR

(75) Inventor: Zhen-Chun Liu, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 93 days.

(21) Appl. No.: 13/532,788

(22) Filed: Jun. 26, 2012

(65) Prior Publication Data

US 2013/0009548 A1 Jan. 10, 2013

(30) Foreign Application Priority Data

Jul. 7, 2011 (TW) ..... 100124042 A

(51) Int. Cl.

| | |
|---|---|
| ***H05B 37/00*** | (2006.01) |
| ***H05B 41/00*** | (2006.01) |
| ***H05B 39/00*** | (2006.01) |
| ***H05B 41/14*** | (2006.01) |
| ***H05B 37/02*** | (2006.01) |
| ***H05B 39/02*** | (2006.01) |
| ***H05B 39/04*** | (2006.01) |
| ***H05B 41/36*** | (2006.01) |
| ***H05B 41/16*** | (2006.01) |
| ***H05B 41/24*** | (2006.01) |

(Continued)

(52) U.S. Cl.

CPC ..... *H05B 41/2827* (2013.01); *H05B 41/2855* (2013.01)

USPC ..... 315/119; 315/200 R; 315/209 R; 315/246; 315/291

(58) Field of Classification Search

None

See application file for complete search history.

(56) References Cited

U.S. PATENT DOCUMENTS 6,359,391 B1 * 3/2002 Li ..... 315/291
6,570,334 B2 * 5/2003 Kastner ..... 315/119

(Continued)

FOREIGN PATENT DOCUMENTS

CN 101155456 4/2008
JP 2008186635 A * 8/2008

(Continued)

OTHER PUBLICATIONS

"Office Action of China Counterpart Application" , issued on Mar. 10, 2014, p1-p7.

(Continued)

*Primary Examiner* — Douglas W Owens
*Assistant Examiner* — Dedei K Hammond
(74) *Attorney, Agent, or Firm* — Winston Hsu; Scott Margo

(57) ABSTRACT

A lighting apparatus for a fluorescent tube and a driving method thereof are provided. The lighting apparatus includes a fluorescent tube, an open-loop protection unit and a driving device. The driving device includes an inverter and a power unit. The open-loop protection unit detects and determines an open-loop situation of two nodes of the fluorescent tube to produce an open-loop protection signal. The inverter receives a power voltage to light the fluorescent tube with a dual high-voltage method according to a trigger signal. The power unit coupled to the open-loop protection unit and the inverter provides the power voltage and determines whether to turn off the inverter according to the open-loop protection signal. When the open-loop situation of the fluorescent tube is occurred or driving voltage of the fluorescent tube is greater than a rated operating voltage, the inverter is turned off immediately to avoid components from overheating or burning.

23 Claims, 3 Drawing Sheets

(51) Int. Cl.

| | |
|---|---|
| ***G05F 1/00*** | (2006.01) |
| ***H05B 41/282*** | (2006.01) |
| ***H05B 41/285*** | (2006.01) |

(56) References Cited

U.S. PATENT DOCUMENTS

| | | | | |
|---|---|---|---|---|
| 6,703,796 | B2 * | 3/2004 | Che-Chen et al. | 315/291 |
| 7,109,667 | B2 * | 9/2006 | Matsushima et al. | 315/224 |
| 8,384,298 | B2 * | 2/2013 | Alexandrov | 315/246 |
| 2011/0043122 | A1 | 2/2011 | Alexandrov | |
| 2012/0001571 | A1 * | 1/2012 | He et al. | 315/307 |
| 2012/0217895 | A1 * | 8/2012 | Lee | 315/276 |

FOREIGN PATENT DOCUMENTS

| | | |
|---|---|---|
| TW | I258726 | 7/2006 |
| TW | I287946 | 10/2007 |
| TW | 200822807 | 5/2008 |
| TW | I305476 | 1/2009 |
| TW | I317117 | 11/2009 |

OTHER PUBLICATIONS

"Office Action of Taiwan Counterpart Application" , issued on Jun. 10, 2014, p1-p6.

* cited by examiner

LIGHTING APPARATUS FOR FLUORESCENT TUBE AND DRIVING METHOD THEREFOR

CROSS-REFERENCE TO RELATED APPLICATION

This application claims the priority benefit of Taiwan application serial no. 100124042, filed on Jul. 7, 2011. The entirety of the above-mentioned patent application is hereby incorporated by reference herein and made a part of this specification.

BACKGROUND OF THE INVENTION

1. Field of the Invention

The invention relates to a lighting apparatus. Particularly, the invention relates to a lighting apparatus for a fluorescent tube with an open-loop protection function and an over-voltage protection function, and a driving method thereof.

2. Description of Related Art

A fluorescent tube is widely used in today's lighting apparatus such as application domains of indoor lighting and backlight modules of display panels, etc. due to its advantages of low working temperature, high light-emitting efficiency, long service life and multiple colors, etc. An electric power conversion circuit is also referred to as an inverter, which is generally used to drive/light a cold cathode fluorescence lamp (CCFL). The inverter receives a direct current (DC) input voltage, and provides an alternating current (AC) driving voltage to the CCFL.

There are two methods for lighting the fluorescent tube: a single high-voltage method and a dual high-voltage method. The single high-voltage method refers to that one end of the fluorescent tube receives a driving voltage provided by the inverter, and the other end of the fluorescent tube is electrically connected to the ground, so that the fluorescent tube is lighted. In an example, the single high-voltage method is also referred to as a lighting method with a high voltage of one side and a low voltage of the other side.

However, based on the single high-voltage method, the lighting apparatus is operated in a positive voltage cycle during a certain period and operated in a negative voltage cycle during another period, which may lead to a low energy conversion efficiency and cause temperature increase of power components in the lighting apparatus, so that a service life of the fluorescent tube is decreased. Comparatively, the lighting apparatus using the dual high-voltage method is to use an electronic device to elevate voltage levels at two ends of the fluorescent tube, so that an AC driving voltage generated by the inverter is only required to oscillate at a single voltage level, for example, the AC driving voltage can be elevated to the positive voltage level. Compared to the single high-voltage method, the dual high-voltage method has a better energy conversion efficiency, which avails reducing a temperature increasing speed of the power device.

The fluorescent tubes in the market are generally lighted through the single high-voltage method, and such type of the lighting technique generally implements circuit protection measures such as open-loop protection and over-voltage protection according to a voltage signal in the fluorescent tube that is close to a ground voltage since the low voltage signal is easy to process, and the circuit protection measures have to be implemented in actual applications. On the other hand, since the driving technique of the dual high-voltage method is novel, and the two ends of the fluorescent tube are all applied with high voltage signals, the conventional circuit protection measure is hard to convert the high voltage signals. In this way, in order to innovate and break through the present known driving technique for the fluorescent tube, the circuit protection measure suitable for the dual high-voltage method is an important issue to be developed in the domain.

SUMMARY OF THE INVENTION

The invention is directed to a lighting apparatus for a fluorescent tube and a driving method thereof, in which when an open-loop situation of the fluorescent tube is occurred or a driving voltage of the fluorescent tube exceeds a rated operating voltage, an inverter is immediately turned off to avoid components from overheating or burning.

The invention provides a lighting apparatus for a fluorescent tube. The lighting apparatus includes a fluorescent tube, an alternating current/direct current (AC/DC) voltage converter, an open-loop protection unit and a driving device. The AC/DC voltage converter receives an AC voltage, and converts the AC voltage into a first DC voltage and a second DC voltage. The open-loop protection unit is coupled to the fluorescent tube and detects and determines an open-loop situation of two ends of the fluorescent tube to generate an open-loop protection signal. The driving device includes an inverter and a power unit. The inverter coupled to the fluorescent tube receives a power voltage, and lights the fluorescent tube with a dual high-voltage method according to a trigger signal. The power unit is coupled to the open-loop protection unit and the inverter, and provides the power voltage, and determines whether to stop providing the power voltage to turn off the inverter according to the open-loop protection signal generated by the open-loop protection unit.

In an embodiment of the invention, the lighting apparatus for the fluorescent tube further includes an over-voltage protection unit, which is coupled between the open-loop protection unit and the power unit. The over-voltage protection unit generates and outputs an over-voltage protection signal when a level of the open-loop protection signal is greater than an operating voltage. In this way, the power unit determines whether or not to stop providing the power voltage according to the open-loop protection signal and the over-voltage protection signal, so as to determine whether or not to turn off the inverter.

In an embodiment of the invention, the power unit includes an oscillation unit, a switch control unit and a switch unit. The oscillation unit is charged by a first DC voltage, and generates a charging voltage and the trigger signal. The switch control unit is charged by the charging voltage, and generates a power supply signal according to the charging voltage and the open-loop protection signal. The switch unit receives a second DC voltage, and determines whether to provide the second DC voltage to serve as the power voltage provided to the inverter according to the power supply signal. In some embodiments, the power unit further includes a regulator unit, and the regulator unit regulates the second DC voltage to the power voltage.

In an embodiment of the invention, the oscillation unit further receives an inverting signal of the inverter, and when the inverter starts to operate, the inverter pulls down the inverting signal to a ground voltage, and the oscillation unit stops generating the charging voltage and the trigger voltage. In this way, when the two ends of the fluorescent tube are not open-looped, the open-loop protection unit constantly enables the open-loop protection signal, and the switch control unit is charged by the open-loop protection signal, and constantly generates the power supply signal when the oscillation unit stops generating the charging voltage. On the other hand, when the two ends of the fluorescent tube are open-looped, the open-loop protection unit disables the open-loop protection signal, and the switch control unit stops generating the power supply signal.

According to another aspect, the invention provides a driving method of a fluorescent tube, which includes following steps. A power voltage is provided to an inverter, and the inverter lights the fluorescent tube with a dual high-voltage method according to a trigger signal. An open-loop situation of two ends of the fluorescent tube is detected to generate an open-loop protection signal. It is determined whether to turn off the inverter according to the open-loop protection signal. Moreover, the aforementioned descriptions can be referred for other implementation details of the driving method of the fluorescent tube.

According to above descriptions, the open-loop protection unit of the invention constantly enables the open-loop protection signal when the fluorescent tube normally operates, so that the switch control unit in the power unit constantly provides the power supply signal, and the inverter normally lights the fluorescent tube. Comparatively, when the fluorescent tube is open-looped (the fluorescent tube is broken or abnormal), the open-loop protection signal is disabled, and providing of the power supply signal is immediately stopped, so as to opportunely turn off the inverter.

On the other hand, if the AC driving voltage output by the inverter is higher than the rated operating voltage, the over-voltage protection unit generates an over-voltage protection signal to immediately turn off the inverter. In this way, when the above two situations occur, the lighting apparatus of the invention can opportunely turn off the inverter, so that the inverter cannot continually elevate the driving voltage of the fluorescent tube to avoid components from overheating or burning.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
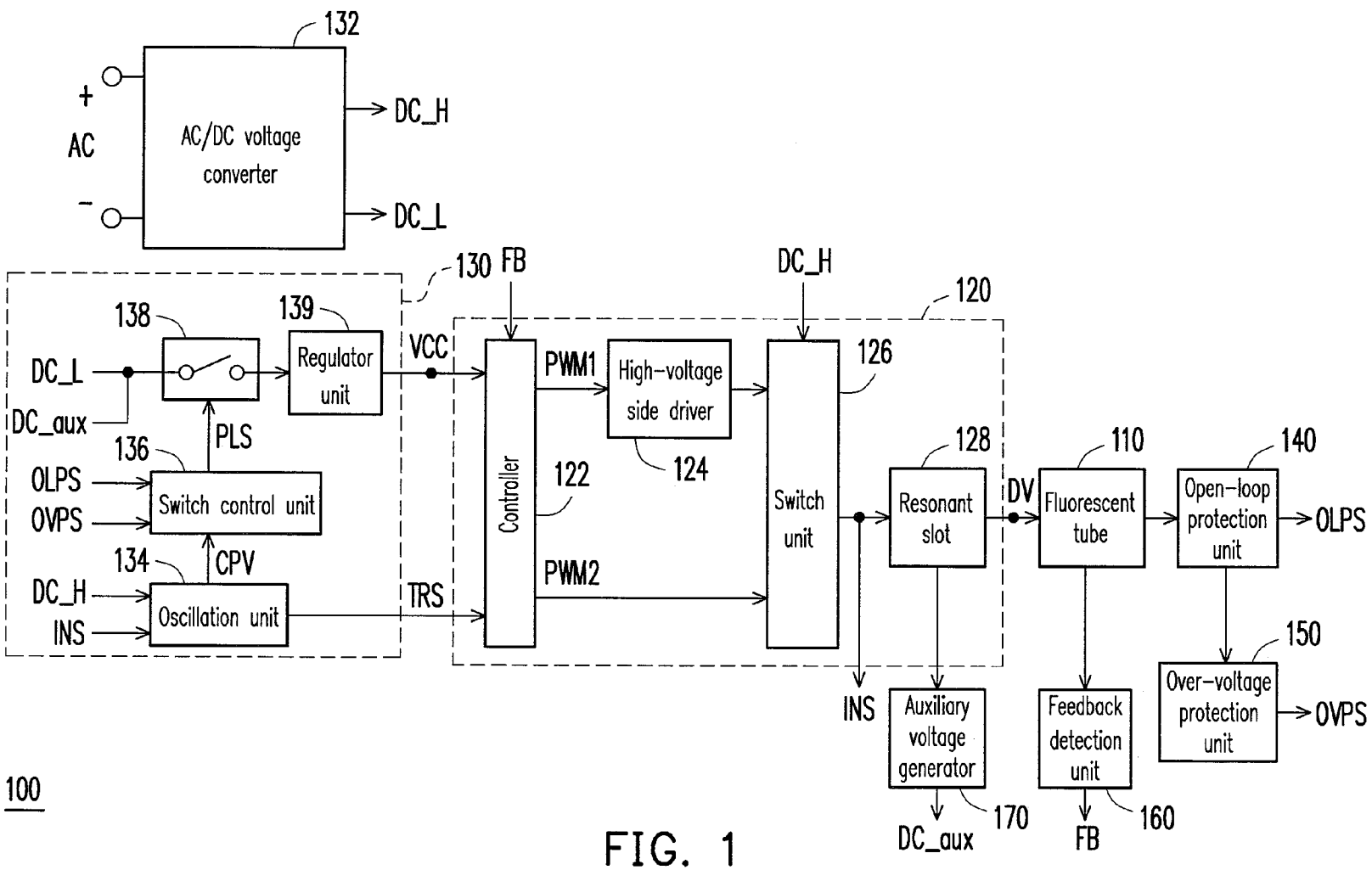
FIG. 1 is a block schematic diagram of a lighting apparatus for a fluorescent tube according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a block schematic diagram of a lighting apparatus 100 for a fluorescent tube 110 according to an embodiment of the invention. Referring to FIG. 1, the lighting apparatus 100 can drive the fluorescent tube 110 for lighting, and the lighting apparatus 100 includes the fluorescent tube 110, an alternating current/direct current (AC/DC) voltage converter 132, an open-loop protection unit 140 and a driving device. The driving device includes an inverter 120 and a power unit 130. In the present embodiment, the lighting apparatus 100 may further include an over-voltage protection unit 150, a feedback detection unit 160 and an auxiliary voltage generator 170, and device structures and operation methods thereof are respectively described below.

The fluorescent tube 110 can be a cold cathode fluorescence tube of a T1 or T3 specification, or can be a hot cathode fluorescence tube of other specifications, so that as long as the fluorescent tube can be lighted/driven through a dual high-voltage method, it belongs to the fluorescent tube 110 of the present embodiment. The power unit 130 is used to provide a power voltage VCC. Regarding a detailed structure of the power unit 130, it includes an oscillation unit 134, a switch control unit 136 and a switch unit 138. Moreover, the power unit 130 also includes a regulator unit 139. Operations of the AC/DC voltage converter 132 and the power unit 130 are introduced below.

The AC/DC voltage converter 132 receives an AC voltage AC, and converts the AC voltage AC into a first DC voltage DC_H and a second DC voltage DC_L, where a level of the first DC voltage DC_H is greater than a level of the second DC voltage, so that the AC/DC voltage converter 132 can respectively provide voltages of different levels to electronic devices. The AC/DC voltage converter 132 can be implemented by an electronic device such as a bridge rectifier or a filter capacitor, etc., which is not described herein.

The oscillation unit 134 is charged by the first DC voltage DC_H, and generates a charging voltage CPV and a trigger signal TRS. The switch control unit 136 is charged by the charging voltage CPV, and generates a power supply signal PLS according to the charging voltage CPV and an open-loop protection signal OLPS. Moreover, the switch unit 138 receives the second DC voltage DC_L, and determines whether to provide the second DC voltage DC_L to serve as the power voltage VCC provided to the inverter 120 according to the power supply signal PLS. The regulator unit 139 is coupled between the switch unit 138 and the inverter 120, and regulates the second DC voltage DC_L to the power voltage VCC.

Referring to FIG. 1, the inverter 120 receives the power voltage VCC and is operated under the power voltage VCC, and generates an AC driving voltage DV according to the trigger signal TRS, so as to light the fluorescent tube 110 through the dual high-voltage method. A detailed structure of the inverter 120 is introduced below. The inverter 120 includes a controller 122, a high-voltage side driver 124, a switch unit 126 and a resonant slot 128.

The controller 122 is operated under the power voltage VCC, and generates a first pulse width modulation (PWM) signal PWM1 and a second PWM signal PWM2 according to the trigger signal TRS. The high-voltage side driver 124 is coupled to the controller 122, and adjusts a level of the first PWM signal PWM1. The switch unit 126 is coupled to the controller 122 and the high-voltage side driver 124. The switch unit 126 receives the first DC voltage DC_H, where the first DC voltage DC_H is controlled by the second PWM signal PWM2 and the adjusted first PWM signal PWM1 to generate an inverting signal INS. By switching a conduction state of the switch unit 126, the electric power of the first DC voltage DC_H that is transmitted to the resonant slot 128 is controlled. In this way, the resonant slot 128 generates the AC driving voltage DV to light the fluorescent tube 110 through the dual high-voltage method.

In order to avoid the oscillation unit 134 to constantly generate the trigger signal TRS during the operation process of the inverter 120, when the inverter 120 starts to operate, the inverting signal INS generated by the switch unit 126 is pulled down to the ground voltage along with switching of the first PWM signal PWM1 and the second PWM signal PWM2, so that the oscillation unit 134 stops generating the charging voltage CPV and the trigger signal TRS. In some embodiments, after the oscillation unit 134 stops generating the charging voltage CPV, the fluorescent tube 110 has been lighted, and now the open-loop protection signal OLPS charges the switch control unit 136 to constantly generate the power supply signal PLS, and the inverter 120 constantly lights the fluorescent tube 110.

However, if now the fluorescent tube 110 is actually not lighted, or when the two ends of the fluorescent tube 110 are in an open-loop state, where the open-loop state is generally occurred when the tube is broken, the tube is not correctly disposed or the tube has abnormity, etc., and now if there is none specific circuit protection measure to implement an open-loop protection function or an over-voltage protection function, etc., the inverter 120 may constantly elevate a voltage level of the AC driving voltage DV.

Since the lighting apparatus 100 lighted by the dual high-voltage method generally makes the voltage level of the AC driving voltage DV to be higher than 300V, in other words, the driving voltage level of the two ends of the fluorescent tube 110 is generally between 300V and 3000V (which is only used as an example, and the invention is not limited thereto). Such high-voltage driving method is easy to cause overheating of the electronic components in the lighting apparatus 100 or even burning of the electronic components due to the excessive driving voltage DV, which reduces a service life of the fluorescent tube 110 and the lighting apparatus 100.

Therefore, the open-loop protection unit 140 and the over-voltage protection unit 150 of FIG. 1 are used to implement the open-loop protection function and the over-voltage protection function. Namely, the open-loop protection unit 140 of FIG. 1 can detect and determine an open-loop situation of the two ends of the fluorescent tube 110 to generate the open-loop protection signal OLPS. The over-voltage protection unit 150 is coupled to the open-loop protection unit 140 and the power unit 130, and generates the over-voltage protection signal OVPS when the level of the open-loop protection signal OLPS is greater than a rated operating voltage. The switch control unit 136 in the power unit 130 determines whether to stop generating the power supply signal PLS according to the open-loop protection signal OLPS and the over-voltage protection signal OVPS, so as to control the switch unit 138 to stop providing the second DC voltage DC_L.

Therefore, when the fluorescent tube 110 is actually not lighted, or the two ends of the fluorescent tube 110 are in the open-loop state, the lighting apparatus 100 of the fluorescent tube 110 can immediately turn off the inverter 120 to avoid the electronic components in the lighting apparatus 100 from overheating or burning, etc., so as to prolong the service life of the fluorescent tube 110 and the lighting apparatus 100.

Referring to FIG. 1, the feedback detection unit 160 detects the fluorescent tube 110, and generates a feedback signal FB according to a detection result. In this way, the controller 122 can adjust a duty cycle or a frequency of the first PWM signal PWM1 and the second PWM signal PWM2 according to the feedback signal FB, so as to improve a lighting efficiency of the fluorescent tube 110. Moreover, the lighting apparatus 100 for the fluorescent tube 110 generates an auxiliary voltage DC_aux through an auxiliary voltage generator 170, and transmits the auxiliary voltage DC_aux to the switching unit 138, so as to stabilize an operation performance of the lighting apparatus 100. In this way, the regulator unit 139 can further use the auxiliary voltage DC_aux to generate the power voltage VCC required by the controller 122. In brief, the auxiliary voltage generator 170 generates the auxiliary voltage DC_aux in response to the resonant slot 128 in the inverter 120.

Figure 2:
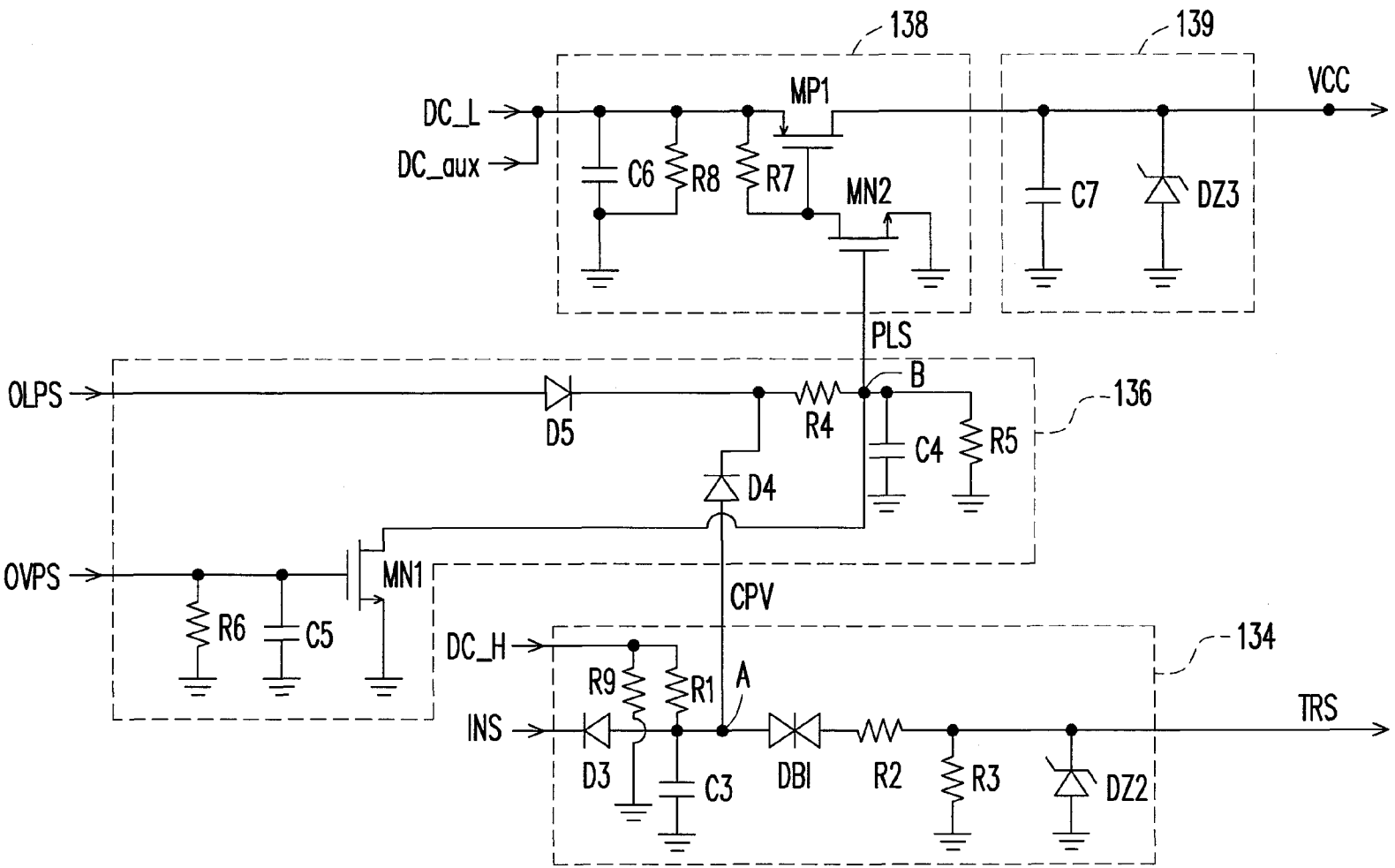
FIG. 2 is a partial circuit diagram of a lighting apparatus for a fluorescent tube according to an embodiment of the invention.

In order to fully convey the spirit of the invention to those skilled in the art, FIG. 2 is a partial circuit diagram of the lighting apparatus 100 for the fluorescent tube 110 according to an embodiment of the invention. Circuit structures of the oscillation unit 134, the switch control unit 138, the switch unit 138 and the regulator unit 139 are described below with reference of FIG. 2.

Referring to FIG. 2, the oscillation unit 134 includes resistors R1-R3, a resistor R9, a capacitor C3, a diode D3, a bilateral diode DBI and a Zener diode DZ2. One ends of the resistor R1 and R9 receive the first DC voltage DC_H, a second end of the resistor R1 provides the charging voltage CPV, and a second end of the resistor R9 is coupled to the ground. A first end of the capacitor C3 is coupled to the second end of the resistor R1, and a second end of the capacitor C3 is coupled to the ground. An anode of the diode D3 is coupled to the second end of the resistor R1, and a cathode of the diode D3 receives the inverting signal INS generated by the switch unit 126 in the inverter 120.

A first anode of the bilateral diode DBI is coupled to a second end of the resistor R1, a first end of the resistor R2 is coupled to a second anode of the bilateral diode DBI, and a second end of the resistor R2 provides the trigger signal TRS. A first end of the resistor R3 is coupled to the second end of the resistor R2, and a second end of the resistor R3 is coupled to the ground. A cathode of the Zener diode DZ2 is coupled to the second end of the resistor R2, and an anode of the Zener diode DZ2 is coupled to the ground.

In circuit operation, it is assumed that the inverter 120 is not yet operational, the inverting signal INS is floating, and the diode D3 is in a non-conducting state. Now, the capacitor C3 is charged by the first DC voltage DC_H through the resistor R1 to generate the charging voltage CPV. When the charging voltage CPV is greater than a threshold voltage of the bilateral diode DBI, the bilateral diode DBI is turned on. Now, a voltage regulation circuit formed by the resistors R2 and R3 and the Zener diode DZ2 generates the trigger signal TRS.

On the other hand, when the inverter 120 starts to operate due to activation of the controller 122, the inverting signal INS generated by the switch unit 126 is pulled down to the ground voltage along with switching of the first PWM signal PWM1 and the second PWM signal PWM2. Now, the diode D3 is in a conducting state, so that a level of a node A approaches to the ground voltage. Therefore, the oscillation unit 134 stops generating the charging voltage CPV and the trigger signal TRS after the inverter 120 starts to operate.

The switch control unit 136 includes resistors R4-R6, capacitors C4-C5, diodes D4-D5 and an N-type transistor MN1. An anode of the diode D4 receives the charging voltage CPV. An anode of the diode D5 receives the open-loop protection signal OLPS, and a cathode of the diode D5 is coupled to the cathode of the diode D4. A first end of the resistor R4 is coupled to the cathode of the diode D4, and a second end of the resistor R4 provides the power supply signal PLS. A first end of the capacitor C4 is coupled to the second end of the resistor R4, and a second end of the capacitor C4 is coupled to the ground. A first end of the resistor R5 is coupled to the second end of the resistor R4, and a second end of the resistor R5 is coupled to the ground.

In the present embodiment, a drain of the N-type transistor MN1 is coupled to the second end of the resistor R4, a gate of the N-type transistor MN1 receives the over-voltage protection signal OVPS, and a source of the N-type transistor MN1 is coupled to the ground. First ends of the capacitor C5 and the resistor R6 are all coupled to the gate of the N-type transistor MN1, and second ends of the capacitors C5 and the resistor R6 are all coupled to the ground.

In circuit operation, it is assumed that the open-loop protection signal OLPS and the over-voltage protection signal OVPS are still not generated, and the switch control unit 136 only receives the charging voltage CPV from the oscillation unit 134. Therefore, the diode D4 is turned on in response to the charging voltage CPV, and the charging voltage CPV charges the capacitor C4 through the resistor R4, and a delay time of charging thereof is determined by an RC effect of the resistor R4 and the capacitor C4. In this way, the switch control unit 136 generates the power supply signal PLS.

Moreover, after the inverter 120 is activated, and the two ends of the fluorescent tube 110 are not in the open-loop state, the open-loop protection unit 140 constantly enables the open-loop protection signal OLPS, and the enabled open-loop protection signal OLPS is transmitted back to the diode D5. Therefore, when the oscillation unit 134 stops generating the charging voltage CPV, the transmitted open-loop protection signal OLPS turns on the diode D5, so as to charge the capacitor C4 through the resistor R4. In this way, even if the oscillation unit 134 stops generating the charging voltage CPV, the switch control unit 136 can still constantly generate the power supply signal PLS when the two ends of the fluorescent tube 110 are not in the open-loop state.

Moreover, when the level of the open-loop protection signal is greater than the rated operation voltage, the over voltage protection unit 150 enables the over-voltage protection signal OVPS (for example, the over-voltage protection signal OVPS is higher than a conduction voltage level of the transistor MN1). In this way, the source and the drain of the N-type transistor MN1 are conducted to pull down the level of the power supply signal PLS to the ground voltage, i.e. a level of a node B approaches to the ground voltage. In this way, the switch unit 138 stops transmitting the second DC voltage DC_L and the auxiliary voltage DC_aux due to that the power supply signal PLS is not provided.

Referring to FIG. 2, the switch unit 138 includes resistors R7-R8, a capacitor C6, a P-type transistor MP1 and an N-type transistor MN2. A source of the P-type transistor MP1 receives the second DC voltage DC_L, and the source of the P-type transistor MP1 is also coupled to a first end of the capacitor C6 and a first end of the resistor R7. A second end of the capacitor C6 is coupled to the ground, and a second end of the resistor R7 is coupled to a gate of the P-type transistor MP1. A drain of the P-type transistor MP1 provides the power voltage VCC. A drain of the N-type transistor MN2 is coupled to the gate of the P-type transistor MP1, and a source of the N-type transistor MN2 is coupled to the ground. Moreover, a gate of the N-type transistor MN2 receives the power supply signal PLS. A first end of the resistor R8 is coupled to the source of the P-type transistor MP1, and a second end of the resistor R8 is coupled to the second end of the capacitor C6.

In this way, in circuit operation, the N-type transistor MN2 conducts the source and drain thereof according to the power supply signal PLS, so as to pull down a level of the gate of the P-type transistor MP1 to the ground voltage. Now, the P-type transistor MP1 is also turned on, so that the second DC voltage DC_L or/and the auxiliary voltage DC_aux is transmitted to the regulator unit 139. The capacitor C6, the resistor R7 and the resistor R8 can be used to adjust a turn-on speed of the P-type transistor MP1.

The regulator unit 139 includes a capacitor C7 and a Zener diode DZ3. A first end of the capacitor C7 is coupled to a cathode of the Zener diode DZ3, and receives the power voltage VCC from the switch unit 138. A second end of the capacitor C7 and an anode of the Zener diode DZ3 are all coupled to the ground. Therefore, in circuit operation, the voltage from the switch unit 138 charges the capacitor C7, and a voltage drop on the capacitor C7 is stabilized to the level of the power voltage VCC through the Zener diode DZ3.

Figure 3:
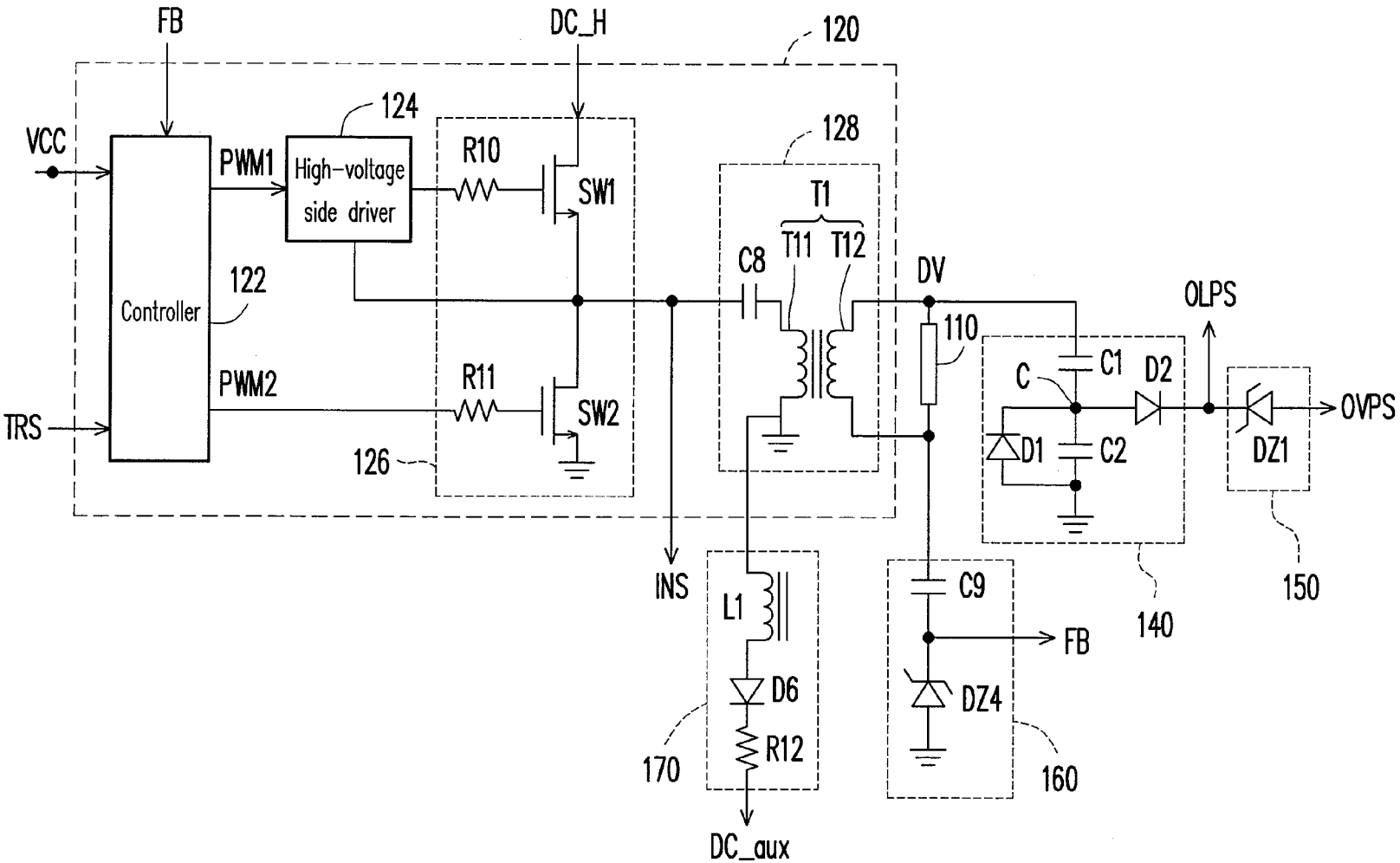
FIG. 3 is another partial circuit diagram of a lighting apparatus for a fluorescent tube according to an embodiment of the invention.

FIG. 3 is another partial circuit diagram of the lighting apparatus 100 for the fluorescent tube 110 according to an embodiment of the invention. Circuit structures of the switch unit 126 and the resonant slot 128 in the inverter 120, the open-loop protection unit 140, the over-voltage protection unit 150, the feedback detection unit 160 and the auxiliary voltage generator 170 are described below with reference of FIG. 3.

Referring to FIG. 3, the switch unit 126 includes resistors R10-R11 and switches SW1-SW2. In the present embodiment, the switches SW1-SW2 are, for example, N-type transistors. In the switch unit 126, a first end of the resistor R10 receives the adjusted first PWM signal PWM1, and a first end of the resistor R11 receives the second PWM signal PWM2. Second ends of the resistor R10 and the resistor R11 are respectively coupled to control terminals (for example, gates of the N-type transistors) of the switch SW1 and the switch SW2. A first terminal of the switch SW1 receives the first DC voltage DC_H, and a second end of the switch SW1 and a first terminal of the switch SW2 are all coupled to the resonant slot 128. A second terminal of the switch SW2 is coupled to the ground.

The resonant slot 128 includes a capacitor C8 and a transformer T1. A first end of the capacitor C8 is coupled to the switch unit 126, and the transformer T1 has a first side winding T11 and a second side winding T12. The first side winding T11 is coupled between a second end of the capacitor C8 and the ground, and the second side winding T12 is connected in parallel to the fluorescent tube 110.

In circuit operation, the switch SW1 receives the adjusted first PWM signal PWM1 through the resistor R10, and the switch SW2 receives the second PWM signal PWM2 through the resistor R11. In this way, the switch SW1 and the switch SW2 adjust their conducting states according to the adjusted first PWM signal PWM1 and the second PWM signal PWM2, so as to control the power transmitted to the resonant slot 128 by the first DC voltage DC_H. The resonant slot 128 can perform boost and filtering operations through the capacitor C8 and the transformer T1, so as to generate the AC driving voltage DV to light the fluorescent tube 110.

It should be noticed that the open-loop protection unit 140 includes capacitors C1-C2 and diodes D1-D2. A first end of the capacitor C1 is coupled to the fluorescent tube 110, a second end of the capacitor C1 is coupled to a first end of the capacitor C2, and a second end of the capacitor C2 is coupled to the ground. An anode and a cathode of the diode D1 are respectively coupled to the ground and the second end of the capacitor C1. An anode of the diode D2 is coupled to the second end of the capacitor C1, and a cathode of the diode D2 provides the open-loop protection signal OLPS. Moreover, the over-voltage protection unit 150 includes a Zener diode DZ1. An anode of the Zener diode DZ1 receives the open-loop protection signal OLPS, and a cathode of the Zener diode DZ1 provides the over-voltage protection signal OVPS.

A breakdown voltage of the Zener diode DZ1 is equal to a rated operating voltage. Namely, the rated operating voltage is an upper limit of the voltage level of the over-voltage protection signal OVPS in a normal operation.

In circuit operation, it is assumed that the two ends of the fluorescent tube 110 are not in the open-loop state and the inverter 120 is activated, the AC driving voltage DV of the fluorescent tube 110 received by the capacitor C1 can produce a suitable voltage on a node C due to a voltage dividing and a charge storage effects of the capacitors C1 and C2 in collaboration with a voltage clamp effect of the diode D1, so that the open-loop protection signal OLPS is schematically maintained to a suitable voltage level. In this way, referring to FIG. 2 and FIG. 3, the open-loop protection unit 140 can constantly enable the open-loop protection signal OLPS, so that the switch control unit 136 constantly provides the power supply signal PLS.

However, after the inverter 120 is activated, if the two ends of the fluorescent tube 110 are suddenly open-looped, the AC driving voltage DV of the fluorescent tube 110 is suddenly elevated, and the voltage level of the over-voltage protection signal OVPS is accordingly elevated. Therefore, in circuit operation, when the over-voltage protection signal OVPS exceeds the breakdown voltage of the Zener diode DZ1, it represents that the AC driving voltage DV is abnormal and exceeds a predetermined voltage level, so that the Zener diode DZ1 of the over-voltage protection unit 150 is broken to conduct two ends thereof, and the voltage level of the over-voltage protection signal OVPS is higher than a turn-on voltage of the N-type transistor MN1 of FIG. 2 to pull down the power supply signal PLS to the ground voltage, so as to stop providing the second DC voltage DC_L and the auxiliary voltage DC_aux to the inverter 120.

Moreover, when the two ends of the fluorescent tube 110 are suddenly open-looped, the AC driving voltage DV is probably converted from a positive voltage level to a negative voltage level, suddenly. Therefore, through the voltage clamp of the diode D1 and the diode D2, the voltage level of the open-loop protection signal OLPS is pulled down to be roughly equal to the ground voltage (which is equivalent to disable the open-loop protection signal OLPS). Therefore, the transmitted open-loop protection signal OLPS cannot charge the capacitor C4 of the switch control unit 136 in FIG. 2, so that the switch control unit 136 stops generating the power supply signal PLS.

Referring to FIG. 3, the feedback detection unit 160 includes a capacitor C9 and a Zener diode DZ4. A first end of the capacitor C9 is electrically connected to the fluorescent tube 110. A cathode of the Zener diode DZ4 is coupled to a second end of the capacitor C9, and an anode of the Zener diode DZ4 is electrically connected to the ground. In circuit operation, the Zener diode DZ4 is used to limit a voltage level of the second end of the capacitor C9. Moreover, the capacitor C9 receives the voltage from the fluorescent tube 110 to generate a corresponding feedback signal FB.

On the other hand, the auxiliary voltage generator 170 includes an inductor L1, a diode D6 and a resistor R12. The inductor L1 induces a current of the first side winding T11 of the transformer T1 to generate an induced current. Moreover, an anode of the diode D6 receives the induced current and transmits it to a first end of the resistor R12. In this way, the auxiliary voltage generator 170 generates the corresponding auxiliary voltage DC_aux through a second end of the resistor R12.

In summary, according to above descriptions, the open-loop protection unit of the invention constantly enables the open-loop protection signal when the fluorescent tube normally operates, so that the switch control unit in the power unit constantly provides the power supply signal, and the inverter normally lights the fluorescent tube. Comparatively, when the fluorescent tube is open-looped (the fluorescent tube is broken or abnormal), the open-loop protection signal is disabled, and providing of the power supply signal is immediately stopped, so as to opportunely turn off the inverter.

On the other hand, if the AC driving voltage output by the inverter is higher than the rated operating voltage, the over-voltage protection unit generates an over-voltage protection signal to immediately turn off the inverter. In this way, when the above two situations occur, the lighting apparatus of the invention can opportunely turn off the inverter, so that the inverter cannot continually elevate the driving voltage of the fluorescent tube to avoid components from overheating or burning.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A lighting apparatus for a fluorescent tube, comprising:

a fluorescent tube, an alternating current/direct current (AC/DC) voltage converter, receives an AC voltage, and converting the AC voltage into a first DC voltage and a second DC voltage;

an open-loop protection unit, coupled to the fluorescent tube, and detecting and determining an open-loop situation of two ends of the fluorescent tube to generate an open-loop protection signal;

a driving device, comprising:

an inverter, coupled to the fluorescent tube, receiving a power voltage, and lighting the fluorescent tube with a dual high-voltage method according to a trigger signal, wherein the lighting apparatus uses the dual high-voltage method for elevating voltage levels at the two ends of the fluorescent tube; and a power unit, coupled to the open-loop protection unit and the inverter to provide the power voltage, and determining whether to turn off the inverter according to the open-loop protection signal, and an over-voltage protection unit, coupled to the open-loop protection unit and the power unit, and generating an over-voltage protection signal when a level of the open-loop protection signal is greater than a rated operating voltage, wherein the power unit determines whether or not to stop providing the power voltage to the inverter according to the open-loop protection signal and the over-voltage protection signal.

2. The lighting apparatus for the fluorescent tube as claimed in claim 1, wherein the over-voltage protection unit comprises:

a first Zener diode, having an anode receiving the open-loop protection signal, a cathode providing the over-voltage protection signal, and a breakdown voltage of the first Zener diode being equal to the rated operating voltage.

3. The lighting apparatus for the fluorescent tube as claimed in claim 1, wherein the open-loop protection unit comprises:

a first capacitor, having a first end coupled to the fluorescent tube;

a second capacitor, having a first end coupled to a second end of the first capacitor, and a second end coupled to ground;

a first diode, having an anode coupled to the ground, and a cathode coupled to the second end of the first capacitor; and a second diode, having an anode coupled to the second end of the first capacitor, and a cathode providing the open-loop protection signal.

4. The lighting apparatus for the fluorescent tube as claimed in claim 1, wherein the open-loop protection unit comprises:

an oscillation unit, charged by a first DC voltage, and generating a charging voltage and the trigger signal;

a switch control unit, charged by the charging voltage, and generating a power supply signal according to the charging voltage and the open-loop protection signal; and a switch unit, receiving a second DC voltage, and determining whether to provide the second DC voltage to serve as the power voltage according to the power supply signal.

5. The lighting apparatus for the fluorescent tube as claimed in claim 4, wherein the oscillation unit receives an inverting signal of the inverter, and when the inverter starts to operate, the inverter pulls down the inverting signal to a ground voltage, and the oscillation unit stops generating the charging voltage and the trigger voltage.

6. The lighting apparatus for the fluorescent tube as claimed in claim 5, wherein when the two ends of the fluorescent tube are not open-looped, the open-loop protection unit constantly enables the open-loop protection signal, and the switch control unit is charged by the open-loop protection signal, and constantly generates the power supply signal when the oscillation unit stops generating the charging voltage, and when the two ends of the fluorescent tube are open-looped, the open-loop protection unit disables the open-loop protection signal, and the switch control unit stops generating the power supply signal.

7. The lighting apparatus for the fluorescent tube as claimed in claim 5, wherein the switch control unit receives an over-voltage protection signal when a level of the open-loop protection signal is greater than a rated operating voltage, so as to stop generating the power supply signal.

8. The lighting apparatus for the fluorescent tube as claimed in claim 4, wherein the oscillation unit comprises:

a first resistor, having a first end receiving the first DC voltage, and a second end providing the charging voltage;

a ninth resistor, having a first end receiving the first DC voltage, and a second end coupled to ground;

a third capacitor, having a first end coupled to a second end of the first resistor, and a second end coupled to the ground;

a third diode, having an anode coupled to the second end of the first resistor, and a cathode receiving an inverting signal of the inverter;

a bilateral diode, having a first anode coupled to the second end of the first resistor;

a second resistor, having a first end coupled to a second anode of the bilateral diode, and a second end providing the trigger signal;

a third resistor, having a first end coupled to the second end of the second resistor, and a second end coupled to the ground; and a second Zener diode, having a cathode coupled to the second end of the second resistor, and an anode coupled to the ground.

9. The lighting apparatus for the fluorescent tube as claimed in claim 4, wherein the switch control unit comprises:

a fourth diode, having an anode receiving the charging voltage;

a fifth diode, having an anode receiving the open-loop protection signal, and a cathode coupled to a cathode of the fourth diode;

a fourth resistor, having a first end coupled to the cathode of the fourth diode, and a second end providing the power supply signal;

a fourth capacitor, having a first end coupled to the second end of the fourth resistor, and a second end coupled to ground; and a fifth resistor, having a first end coupled to the second end of the fourth resistor, and a second end coupled to the ground, wherein, the switch control unit constantly generates the power supply signal by using the charging voltage or the open-loop protection signal.

10. The lighting apparatus for the fluorescent tube as claimed in claim 9, wherein the switch control unit further comprises:

a first N-type transistor, having a drain coupled to the second end of the fourth resistor, a gate receiving an over-voltage protection signal, and a source coupled to the ground;

a fifth capacitor, having a first end coupled to the gate of the first N-type transistor, and a second end coupled to the ground; and a sixth resistor, having a first end coupled to the gate of the first N-type transistor, and a second end coupled to the ground, wherein when the over-voltage protection signal is enabled, a level of the power supply signal is pulled down to a ground voltage, and the switch unit stops transmitting the second DC voltage.

11. The lighting apparatus for the fluorescent tube as claimed in claim 4, wherein the switch unit comprises:

a sixth capacitor, having a first end receiving the second DC voltage, and a second end coupled to ground;

a P-type transistor, having a source receiving the second DC voltage, and a drain providing the power voltage;

a seventh resistor, having a first end coupled to the source of the P-type transistor, and a second end coupled to a gate of the P-type transistor;

an eighth resistor, having a first end coupled to the source of the P-type transistor, and a second end coupled to the second end of the sixth capacitor; and a second N-type transistor, having a drain coupled to the gate of the P-type transistor, a gate receiving the power supply signal, and a source coupled to the ground, wherein the second N-type transistor is turned on according to the power supply signal.

12. The lighting apparatus for the fluorescent tube as claimed in claim 4, wherein the power unit further comprises:

a regulator unit, coupled between the switch unit and the inverter, and stabilizing the second DC voltage to the power voltage.

13. The lighting apparatus for the fluorescent tube as claimed in claim 12, wherein the regulator unit comprises:

a seventh capacitor, having a first end receiving the second DC voltage from the switch unit, and a second end coupled to ground; and a third Zener diode, having a cathode coupled to the first end of the seventh capacitor, and an anode coupled to the ground.

14. The lighting apparatus for the fluorescent tube as claimed in claim 1, wherein the inverter comprises:

a controller, operated under the power voltage, and generating a first pulse width modulation signal and a second pulse width modulation signal according to the trigger signal;

a high-voltage side driver, coupled to the controller, and adjusting a level of the first pulse width modulation signal;

a switch unit, coupled to the controller and the high-voltage side driver, receiving the first DC voltage, and controlled by the second pulse width modulation signal and the adjusted first pulse width modulation signal; and a resonant slot, coupled to the switch unit, and generating the driving voltage to light the fluorescent tube.

15. The lighting apparatus for the fluorescent tube as claimed in claim 14, wherein the switch unit comprises:

a tenth resistor, having a first end receiving the adjusted first pulse width modulation signal;

an eleventh resistor, having a first end receiving the second pulse width modulation signal;

a first switch, having a first terminal receiving the first DC voltage, and a control terminal coupled to a second end of the tenth resistor, and a second terminal coupled to the resonant slot; and a second switch, having a first terminal coupled to the second terminal of the first switch, a control terminal coupled to a second end of the eleventh resistor, and a second terminal coupled to ground.

16. The lighting apparatus for the fluorescent tube as claimed in claim 14, wherein the resonant slot comprises:

an eighth capacitor, having a first end coupled to the switch unit; and a transformer, having a first side winding and a second side winding, wherein the first side winding is coupled between a second end of the eighth capacitor and ground, and the second side winding and the fluorescent tube are connected in parallel.

17. The lighting apparatus for the fluorescent tube as claimed in claim 14, further comprising:

a feedback detection unit, detecting the fluorescent tube, and generating a feedback signal according to a detection result, wherein the controller adjusts the first pulse width modulation signal and the second pulse width modulation signal according to the feedback signal.

18. The lighting apparatus for the fluorescent tube as claimed in claim 17, wherein the feedback detection unit comprises:

a ninth capacitor, having a first end coupled to the fluorescent tube, and a second end providing the feedback signal; and a fourth Zener diode, having a cathode coupled the second end of the ninth capacitor, and an anode coupled to ground.

19. The lighting apparatus for the fluorescent tube as claimed in claim 14, further comprising:

an auxiliary voltage generator, generating an auxiliary voltage according to the resonant slot, wherein the switch unit receives the auxiliary voltage, and transmits the auxiliary voltage according to the power supply signal.

20. The lighting apparatus for the fluorescent tube as claimed in claim 19, wherein the auxiliary voltage generator comprises:

an inductor, inducing a current in the resonant slot, and generating an induced current;

a sixth diode, having an anode receiving the induced current; and a twelfth resistor, having a first end coupled to a cathode of the sixth diode, and a second end generating the auxiliary voltage.

21. A driving method of a fluorescent tube, comprising:

providing a power voltage to an inverter, wherein the inverter lights the fluorescent tube with a dual high-voltage method according to a trigger signal, wherein the dual high-voltage method is used for elevating voltage levels at two ends of the fluorescent tube;

detecting an open-loop situation of two ends of the fluorescent tube to generate an open-loop protection signal;

determining whether to turn off the inverter according to the open-loop protection signal;

receiving an AC voltage, and converting the AC voltage into a first DC voltage and a second DC voltage;

charging through the first DC voltage, so as to generate a charging voltage and the trigger signal;

charging through the charging voltage, and generating a power supply signal according to the charging voltage and the open-loop protection signal; and receiving the second DC voltage, and determining whether to provide the second DC voltage to serve as the power voltage for providing to the inverter according to the power supply signal.

22. The driving method of the fluorescent tube as claimed in claim 21, wherein the step of determining whether to turn off the inverter according to the open-loop protection signal comprises:

after the inverter starts to operate, the inverter pulling down the inverting signal to the ground voltage, so as to stop generating the charging voltage and the trigger signal;

when the two ends of the fluorescent tube are not open-looped, constantly enabling the open-loop protection signal so as to charge through the open-loop protection signal, and constantly generating the power supply signal when generation of the charging voltage is stopped; and when the two ends of the fluorescent tube are open-looped, disabling the open-loop protection signal, so as to stop generating the power supply signal.

23. The driving method of the fluorescent tube as claimed in claim 21, further comprising:

generating an over-voltage protection signal when a level of the open-loop protection signal is greater than a rated operating voltage; and to stop providing the power voltage to the inverter when the over-voltage protection signal is enabled.

* * * * *